US009139276B2

(12) United States Patent
Ito

(10) Patent No.: US 9,139,276 B2
(45) Date of Patent: Sep. 22, 2015

(54) OUTBOARD MOTOR CONTROL SYSTEM

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/368,810

(22) PCT Filed: May 9, 2012

(86) PCT No.: PCT/JP2012/061864

§ 371 (c)(1),
(2), (4) Date: Jun. 26, 2014

(87) PCT Pub. No.: WO2013/118315

PCT Pub. Date: Aug. 15, 2013

(65) Prior Publication Data

US 2014/0329422 A1 Nov. 6, 2014

(30) Foreign Application Priority Data

Feb. 10, 2012 (JP) ..... 2012-027330

(51) Int. Cl.

| | |
|---|---|
| ***B63H 21/22*** | (2006.01) |
| ***B63H 20/12*** | (2006.01) |
| ***B63H 5/08*** | (2006.01) |
| ***B63H 21/21*** | (2006.01) |

(Continued)

(52) U.S. Cl.

CPC ..... *B63H 20/12* (2013.01); *B63H 5/08* (2013.01); *B63H 21/21* (2013.01); *B63H 21/265* (2013.01); *B63H 25/02* (2013.01); *B63H 25/42* (2013.01); *B63H 2020/003* (2013.01)

(58) Field of Classification Search

USPC ..... 440/1, 53; 701/21; 114/144 R
IPC ..... B63H 2021/216; G05D 1/0206
See application file for complete search history.

(56) References Cited

U.S. PATENT DOCUMENTS 7,930,986 B2 * 4/2011 Mizutani ..... 114/144 R
8,170,734 B2 * 5/2012 Kaji ..... 701/21

(Continued)

FOREIGN PATENT DOCUMENTS

JP 2002-220094 A 8/2002
JP 2005-315219 A 11/2005

(Continued)

OTHER PUBLICATIONS

Official Communication issued in International Patent Application No. PCT/JP2012/061864, mailed on Aug. 14, 2012.

*Primary Examiner* — Stephen Avila
(74) *Attorney, Agent, or Firm* — Keating & Bennett, LLP

(57) ABSTRACT

A plurality of outboard motors are mounted to a stern of a watercraft and configured to be steered independently. A target steering angle setting section is configured to set a target steering angle for each of the outboard motors. Actuators are configured to steer the outboard motors such that the steering angle of each of the outboard motors is equal or substantially equal to a target steering angle. An actual steering angle detecting section is configured to detect an actual steering angle of each of the outboard motors. A control section is programmed and configured to control the steering operation of the outboard motors such that, when a steering angle difference defining a difference between the actual steering angles of adjacently arranged outboard motors becomes equal to or larger than a prescribed value, an increase of the steering angle difference is prevented.

8 Claims, 13 Drawing Sheets

(51) Int. Cl.

| | |
|---|---|
| *B63H 25/02* | (2006.01) |
| *B63H 20/00* | (2006.01) |
| *B63H 25/42* | (2006.01) |

(56) References Cited

U.S. PATENT DOCUMENTS

| | | | | |
|---|---|---|---|---|
| 8,170,735 | B2 * | 5/2012 | Kaji | 701/21 |
| 2005/0245145 | A1 | 11/2005 | Takada et al. | |
| 2006/0166567 | A1 | 7/2006 | Otobe et al. | |
| 2007/0207683 | A1 | 9/2007 | Mizutani | |
| 2008/0254689 | A1 * | 10/2008 | Kaji | 440/1 |
| 2009/0111339 | A1 * | 4/2009 | Suzuki | 440/1 |
| 2010/0151750 | A1 | 6/2010 | Ito | |
| 2011/0010028 | A1 | 1/2011 | Mizutani et al. | |

FOREIGN PATENT DOCUMENTS

| | | | |
|---|---|---|---|
| JP | 2006-199189 | A | 8/2006 |
| JP | 2007-83795 | A | 4/2007 |
| JP | 2010-143322 | A | 7/2010 |
| JP | 2011-016502 | A | 1/2011 |

* cited by examiner

OUTBOARD MOTOR CONTROL SYSTEM

BACKGROUND OF THE INVENTION

1. Field of the Invention

The present invention relates to a control system for an outboard motor.

2. Description of the Related Art

There are conventional watercrafts in which a plurality of outboard motors are installed on a stern of the watercraft and the outboard motors are coupled together with a rod-shaped device called a tie bar. In such a watercraft, steering angles of the outboard motors are changed in a coordinated manner. Thus, when the steering angle of the outboard motors is changed, the outboard motors are steered such that a prescribed distance is maintained between the outboard motors. In this manner, a situation in which outboard motors are oriented in different directions from each other does not occur.

Conversely, Laid-open Japanese Patent Application Publication No. 2007-083795 and Laid-open Japanese Patent Application Publication No. 2006-199189 disclose watercrafts in which a plurality of outboard motors are not coupled with a tie bar and, instead, steering angles of the outboard motors are controlled individually. More specifically, in the watercraft disclosed in Laid-open Japanese Patent Application Publication No. 2007-083795, the steering angles of the outboard motors are set according to a traveling performance mode selected by a helmsperson. In the watercraft disclosed in Laid-open Japanese Patent Application Publication No. 2006-199189, target steering angles for a port-side outboard motor and a starboard-side outboard motor are set individually based on a rotation angle of a steering wheel and an engine rotational speed.

In watercrafts such as these, in which a plurality of outboard motors are not coupled with a tie bar, it is possible for a condition to occur in which the steering angles of the outboard motors are greatly different. In such a case, it is possible for one outboard motor to become too close to an adjacent outboard motor such that the outboard motors collide with each other. Laid-open Japanese Patent Application Publication No. 2010-143322 discloses a watercraft in which target steering angles of a plurality of outboard motors are controlled individually such that the steering angle of an outboard motor is larger the farther downstream the outboard motor is positioned in a steering direction. In this manner, a collision between outboard motors is prevented in a watercraft equipped with a plurality of outboard motors not coupled with a tie bar.

Even if the target steering angles are set to angles at which the outboard motors will not collide with each other, there is a possibility that portions of the outboard motors (for instance, their protection covers or their propellers) will collide with each other during a steering operation of the outboard motors. There are times when, for example, a portion of the outboard motors will be replaced with new outboard motors due to a breakdown or other trouble. In such a case, it is possible for the amount of friction occurring in a steering apparatus of a new outboard motor to be different from the amount of friction occurring in the steering apparatus of the original outboard motor. There is a possibility that such a difference in the amount of friction will cause a difference in an engine angular displacement speed of an outboard motor, which is a speed at which the outboard motor is rotated around its steering axis, and result in a collision between the outboard motors. Also, since a state in which the steering angles of the outboard motors differ greatly occurs, there is a possibility that a steering performance of the watercraft will decline.

Additionally, when a difference of the engine angular displacement speed occurs between the outboard motors, there is a possibility that the outboard motors will become greatly separated from each other instead of colliding in the manner explained above. In a case of separation, too, since a state in which the steering angles of the outboard motors differ greatly occurs, there is a possibility that a steering performance of the watercraft will decline.

SUMMARY OF THE INVENTION

Accordingly, preferred embodiments of the present invention provide an outboard motor control system for a watercraft including a plurality of outboard motors installed such that their steering angles are configured to be set individually, wherein the control system prevents a large steering angle difference from occurring.

An outboard motor control system according to a preferred embodiment of the present invention includes a plurality of outboard motors, a target steering angle setting section, a plurality of actuators, an actual steering angle detecting section, and a control section. The outboard motors are mounted to a stern of the watercraft. The outboard motors are configured to be steered independently. The target steering angle setting section is configured to set a target steering angle for each of the outboard motors. The actuators are configured to steer the outboard motors such that a steering angle each of the outboard motors becomes equal or substantially equal to the target steering angle. The actual steering angle detecting section is configured to detect an actual steering angle of each of the outboard motors. The control section is programmed and configured to control the steering operation of the outboard motors such that, when a steering angle difference defining a difference between the actual steering angles of adjacently arranged outboard motors becomes equal to or larger than a prescribed value, an increase of the steering angle difference is prevented.

An outboard motor control method according to another preferred embodiment of the present invention includes a method for controlling a plurality of outboard motors that are mounted on a stern of a watercraft and are configured to be steered independently. The method preferably includes the following steps. In a first step, a target steering angle is set for each of the outboard motors. In a second step, the outboard motors are steered such that a steering angle of each of the outboard motors becomes equal or substantially equal to the target steering angle. In a third step, an actual steering angle is detected for each of the outboard motors. In a fourth step, the steering operation of the outboard motors is controlled such that, when a steering angle difference defining a difference between the actual steering angles of adjacently arranged outboard motors becomes equal to or larger than a prescribed value, an increase of the steering angle difference is prevented.

An outboard motor control system according to a preferred embodiment of the present invention controls a steering operation of the outboard motors such that when a steering angle difference between adjacently arranged outboard motors becomes equal to or larger than a prescribed value, an increase of the steering angle difference is prevented. Consequently, an occurrence of a large steering angle difference is prevented in a watercraft installed with a plurality of outboard motors whose steering angles are configured to be set individually.

An outboard motor control method according to a preferred embodiment of the present invention controls a steering operation of the outboard motors such that when a steering angle difference between adjacently arranged outboard motors becomes equal to or larger than a prescribed value, an increase of the steering angle difference is prevented. Consequently, an occurrence of a large steering angle difference is prevented in a watercraft installed with a plurality of outboard motors whose steering angles are configured to be set individually.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
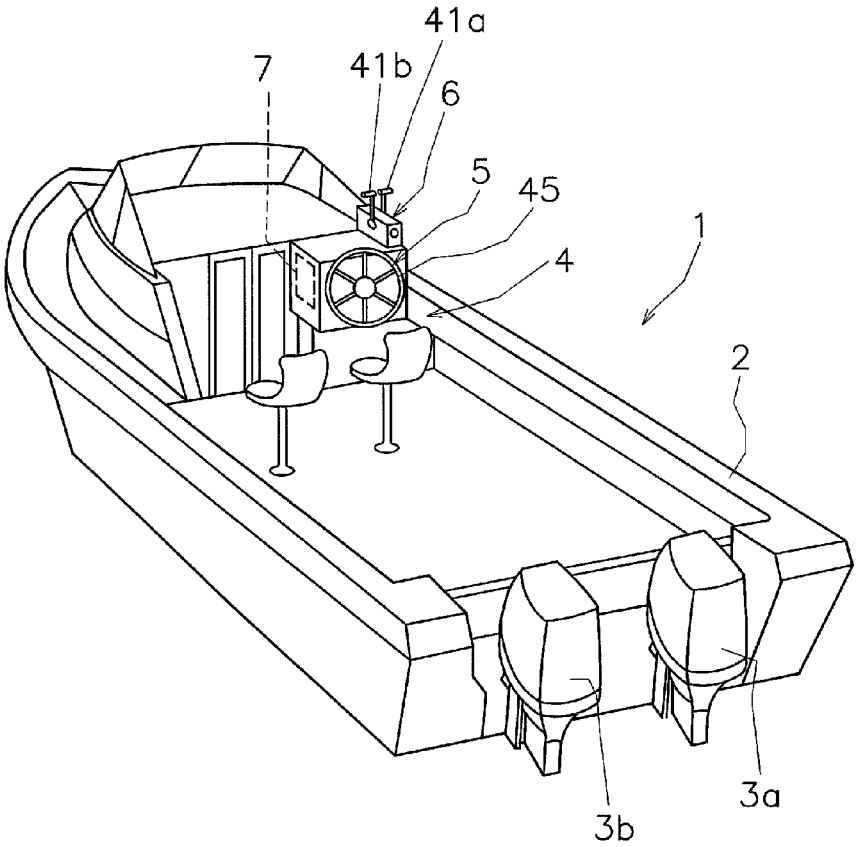
FIG. 1 is a perspective view of a watercraft equipped with an outboard motor control system according to a preferred embodiment of the present invention.

Preferred embodiments of the present invention will now be explained with reference to the drawings. FIG. 1 is a perspective view of a watercraft 1. The watercraft 1 is equipped with an outboard motor control system according to a preferred embodiment of the present invention. As shown in FIG. 1, the watercraft 1 includes a hull 2 and a plurality of outboard motors 3*a* and 3*b*. In the present preferred embodiment, the watercraft preferably has two outboard motors (hereinafter called "first outboard motor 3*a*" and "second outboard motor 3*b*"), for example. The first outboard motor 3*a* and the second outboard motor 3*b* are mounted on a stern of the hull 2. The first outboard motor 3*a* and the second outboard motor 3*b* are arranged side-by-side along a widthwise direction of the hull 2. The first outboard motor 3*a* and the second outboard motor 3*b* are arranged closely adjacent to each other. More specifically, the first outboard motor 3*a* is arranged on a starboard side of the stern. The second outboard motor 3*b* is arranged on a port side of the stern. The first outboard motor 3*a* and the second outboard motor 3*b* each generate a propulsion force that propels the watercraft 1.

The hull 2 includes a helm seat 4. A steering device 5, a remote control device 6, and a controller 7 are arranged at the helm seat 4. The steering device 5 is a device with which an operator manipulates a turning direction of the watercraft 1. The remote control device 6 is a device with which an operator adjusts a vessel speed. The remote control device 6 is also a device with which an operator switches between forward and reverse driving of the watercraft 1. The controller 7 controls the outboard motors 3*a* and 3*b* in accordance with operating signals from the steering device 5 and the remote control device 6.

Figure 2:
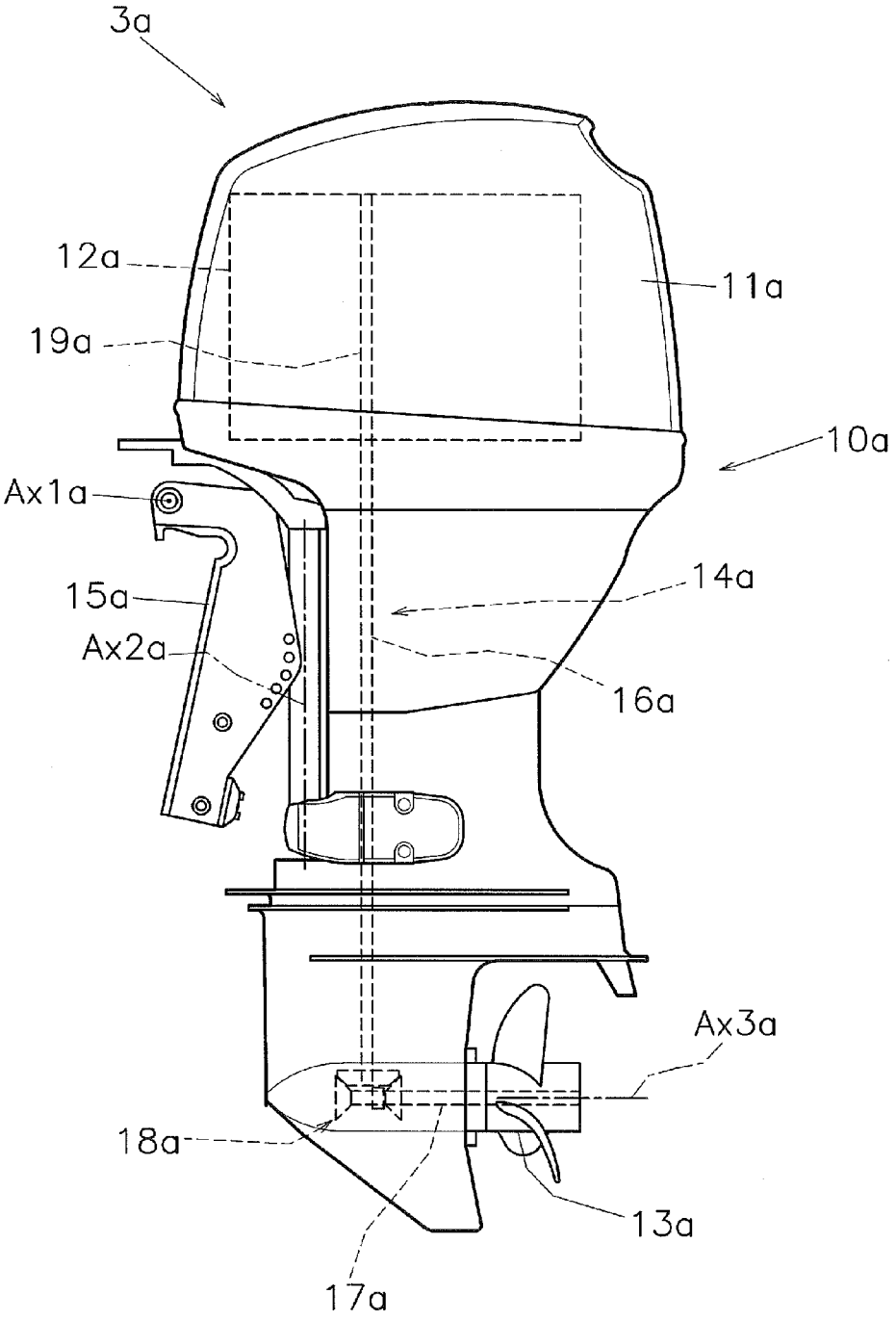
FIG. 2 is a side view of an outboard motor.

FIG. 2 is a side view of the first outboard motor 3*a*. The structure of the first outboard motor 3*a* will now be explained; the structure of the second outboard motor 3*b* is the same as the structure of the first outboard motor 3*a*. The first outboard motor 3*a* includes an engine main body 10*a* and a bracket 15*a*. The engine main body 10*a* includes a cover member 11*a*, a first engine 12*a*, a propeller 13*a*, and a power transmitting mechanism 14*a*. The cover member 11*a* houses the first engine 12*a* and the power transmitting mechanism 14*a*. The first engine 12*a* is arranged in an upper portion of the first outboard motor 3*a*. The first engine 12*a* is an example of a power source that generates power to propel the watercraft 1. The propeller 13*a* is arranged in a lower portion of the first outboard motor 3*a*. The propeller 13*a* is rotationally driven by a drive force from the first engine 12*a*. The power transmitting mechanism 14*a* transmits a drive force from the first engine 12*a* to the propeller 13*a*. The power transmitting mechanism 14*a* includes a drive shaft 16*a*, a propeller shaft 17*a*, and a shift mechanism 18*a*. The drive shaft 16*a* is arranged along a vertical direction.

The drive shaft 16*a* is coupled to a crankshaft 19*a* of the first engine 12*a* and transmits power from the first engine 12*a*. The propeller shaft 17*a* is arranged along a longitudinal direction (front-back direction) of the hull 2. The propeller shaft 17*a* connects to a lower portion of the drive shaft 16*a* through the shift mechanism 18*a*. The propeller shaft 17*a* transmits a drive force from the drive shaft 16*a* to the propeller 13*a*. The shift mechanism 18*a* is configured to change a rotation direction of power transmitted from the drive shaft 16*a* to the propeller shaft 17*a*.

The bracket 15*a* is a mechanism configured to mount the first outboard motor 3*a* to the hull 2. The first outboard motor 3*a* is fixed detachably to the stern of the hull 2 through the bracket 15*a*. The first outboard motor 3*a* is mounted such that it turns about a tilt axis Ax1*a* of the bracket 15*a*. The tilt axis Ax1*a* extends in a widthwise direction of the hull 2. The first outboard motor 3*a* is mounted such that it turns about a steering axis Ax2*a* of the bracket 15*a*. A steering angle is changed by turning the first outboard motor 3*a* about the steering axis Ax2*a*. The steering angle is an angle between the engine main body 10*a* and the bracket 15*a*. Thus, the steering angle is an angle that a rotational axis Ax3*a* of the propeller 13*a* makes with the centerline extending along a longitudinal direction of the hull 2. Also, by turning the first outboard motor 3*a* about the tilt axis Ax1*a*, a trim angle of the first outboard motor 3*a* is changed. The trim angle is equivalent to a mounting angle of the outboard motor with respect to the hull 2.

Figure 3:
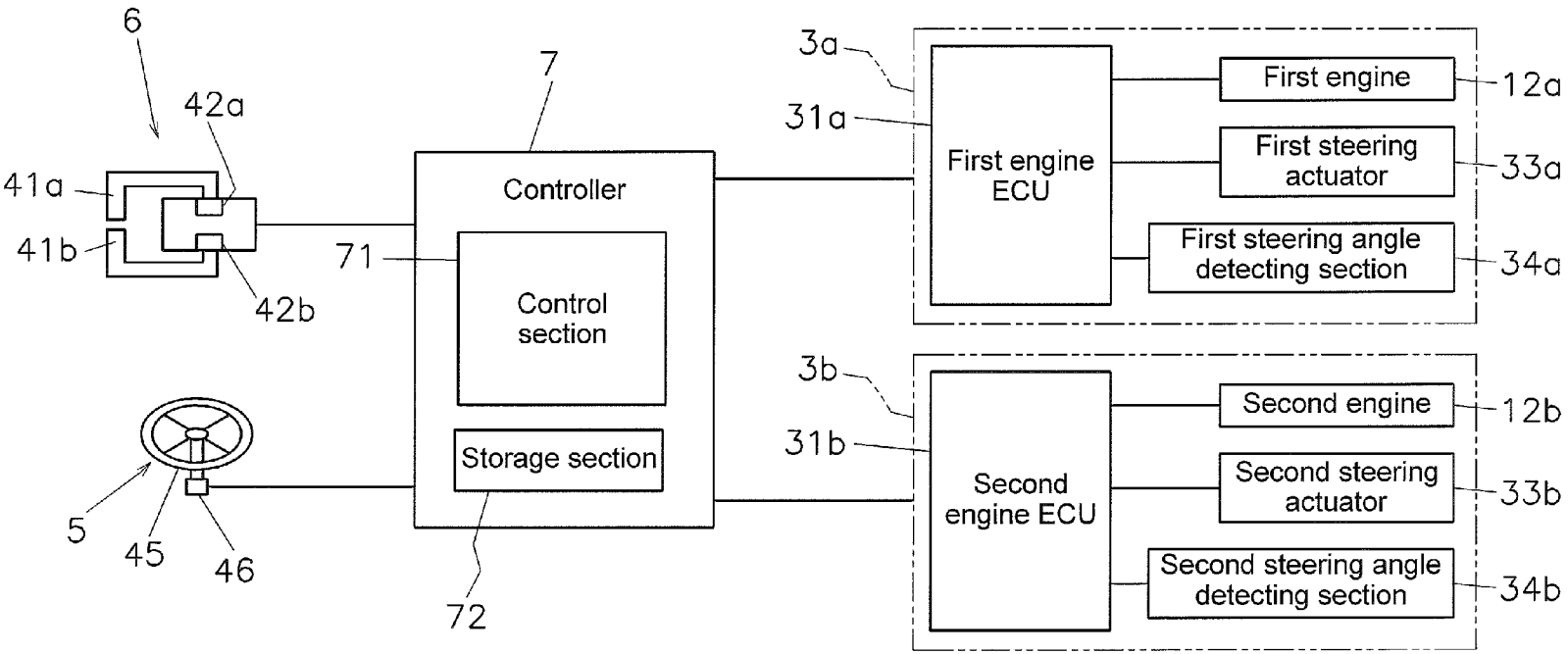
FIG. 3 is a block diagram showing constituent features of an outboard motor control system.

FIG. 3 is a block diagram showing constituent features of an outboard motor control system according to a preferred embodiment of the present invention. The outboard motor control system includes the first outboard motor 3*a*, the second outboard motor 3*b*, the steering device 5, the remote control device 6, and the controller 7.

The first outboard motor 3*a* includes the first engine 12*a*, a first engine ECU 31*a* (electronic control unit), a first steering actuator 33*a*, and a first steering angle detecting section 34*a*.

The first steering actuator 33*a* turns the first outboard motor 3*a* about the steering axis Ax2*a* of the bracket 15*a*. In this manner, the steering angle of the first outboard motor 3*a* is changed. The first steering actuator 33*a* steers the first outboard motor 3*a* such that the steering angle of the first outboard motor 3*a* becomes equal to a target steering angle explained below. The first steering actuator 33*a* includes, for example, a hydraulic cylinder. The first steering angle detecting section 34*a* detects an actual steering angle of the first outboard motor 3*a*. The first steering angle detecting section 34*a* is an example of the steering angle detecting section. If the first steering actuator 33*a* is a hydraulic cylinder, then the first steering angle detecting section 34*a* is, for example, a stroke sensor for a hydraulic cylinder. The first steering angle detecting section 34*a* sends a detection signal to the first engine ECU 31*a*.

The first engine ECU 31*a* stores a control program for the first engine 12*a*. The first engine ECU 31*a* controls operations of the first engine 12*a* and the first steering actuator 33*a* based on a signal from the steering device 5, a signal from the remote control device 6, a detection signal from the first steering angle detecting section 34*a*, and detection signals from other sensors (not shown in the drawings) installed in the first outboard motor 3*a*. The first engine ECU 31*a* is connected to the controller 7 through a communication line.

The second outboard motor 3*b* includes the second engine 12*b*, a second engine ECU 31*b*, a second steering actuator 33*b*, and a second steering angle detecting section 34*a*. Since the component devices of the second outboard motor 3*b* have the same functions as the component devices of the first outboard motor 3*a*, detailed descriptions of these devices will be omitted. Also, in FIG. 3 component devices of the first outboard motor 3*a* and the second outboard motor 3*b* that correspond to each other are indicated with the same reference numerals.

The remote control device 6 includes a first operating member 41*a*, a first operating position sensor 42*a*, a second operating member 41*b*, and a second operating position sensor 42*b*. The first operating member 41*a* preferably is, for example, a lever. The first operating member 41*a* is configured to be inclined forward and rearward. The first operating position sensor 42*a* detects an operating position of the first operating member 41*a*. A detection signal from the first operating position sensor 42*a* is transmitted to the controller 7. An operator changes a rotation direction of the propeller 13*a* of the first outboard motor 3*a* between a forward direction and a reverse direction by operating the first operating member 41*a*. Also, a target engine rotational speed of the first outboard motor 3*a* is set to a value corresponding to the operating position of the first operating member 41*a*. Thus, the operator is capable of adjusting a rotational speed of the propeller 13*a* of the first outboard motor 3*a*. The second operating member 41*b* preferably is, for example, a lever. The second operating member 41*b* is arranged side-by-side (left and right) with the first operating member 41*a*. The second operating member 41*b* is configured to be inclined forward and rearward. The second operating position sensor 42*b* detects an operating position of the second operating member 41*b*. A detection signal from the second operating position sensor 42*b* is transmitted to the controller 7. An operator changes a rotation direction of the propeller of the second outboard motor 3*b* between a forward direction and a reverse direction by operating the second operating member 41*b*. A target engine rotational speed of the second outboard motor 3*b* is set to a value corresponding to the operating position of the second operating member 41*b*. Thus, the operator is capable of adjusting a rotational speed of the propeller of the second outboard motor 3*b*.

The steering device 5 includes a steering member 45 and a steering position sensor 46. The steering member 45 preferably is, for example, a steering wheel. The steering member 45 is a member configured to set a target steering angle of the first and second outboard motors 3*a* and 3*b*. The steering position sensor 46 detects an operating amount, i.e., an operating angle, of the steering member 45. A detection signal from the steering position sensor 46 is transmitted to the controller 7. When an operator operates the operating member 45, the first steering actuator 33*a* and the second steering actuator 33*b* are driven. As a result, the operator is able to adjust an advancing direction of the watercraft 1. The controller 7 controls the first steering actuator 33*a* and the second steering actuator 33*b* independently. Thus, the first and second outboard motors 3*a* and 3*b* are steered independently of each other.

Figure 4:
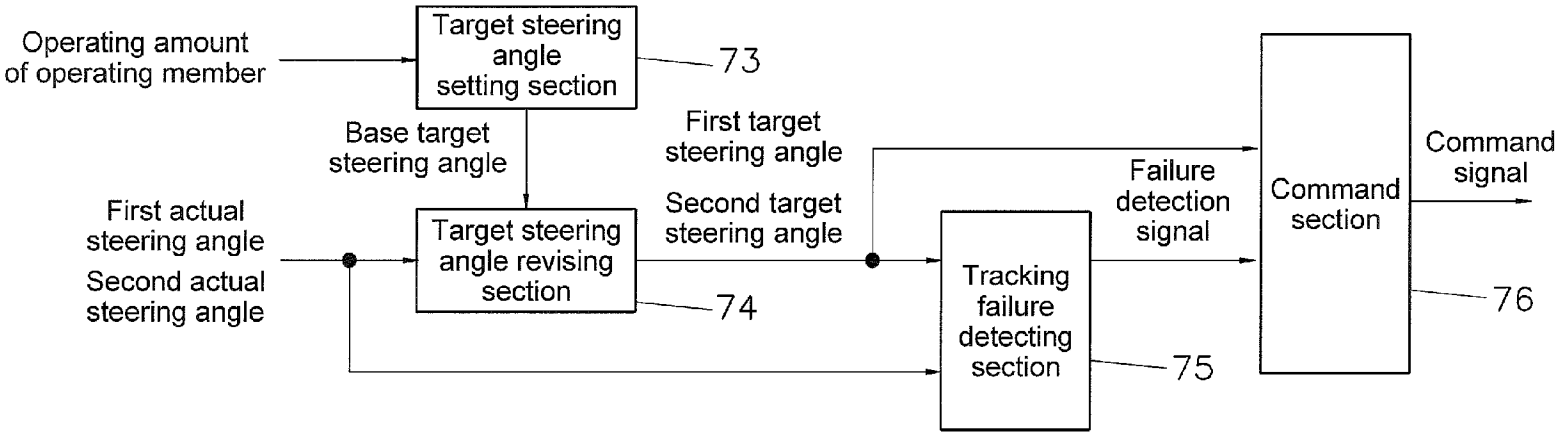
FIG. 4 is a block diagram showing constituent features of a control section.

The controller 7 includes a control section 71 and a storage section 72. The control section 71 includes a CPU or other processing device. The storage section 72 includes a semiconductor storage section, e.g., a RAM or a ROM, or such a storage device as a hard disk or a flash memory. The storage section 72 stores programs and data to control the first and second outboard motors 3*a* and 3*b*. The controller 7 sends command signals to the first and second engine ECUs 31*a* and 31*b* based on signals from the remote control device 6. In this manner, the first and second engines 12*a* and 12*b* are controlled. The controller 7 sends command signals to the first and second steering actuators 33*a* and 33*b* based on signals from the steering device 5. In this manner, the first and second steering actuators 33*a* and 33*b* are controlled. FIG. 4 shows processing executed by the control section 71 of the controller 7. The control section 71 executes a target steering angle revision process and a tracking failure detection process. The target steering angle revision process serves to minimize or prevent an increase of a steering angle difference. The tracking failure detection process detects if a tracking performance of the outboard motors in response to operation of the steering member 45 has failed. As shown in FIG. 4, the control section 71 includes a target steering angle setting section 73, a target steering angle revising section 74, a tracking failure detecting section 75, and a command section 76.

The target steering angle setting section 73 sets target steering angles of the outboard motors 3*a* and 3*b* based on an operating amount of the steering member 45. For example, the target steering angle setting section 73 stores information in a table or map to specify a relationship between the operating amount of the steering member 45 and the target steering angles of the outboard motors 3*a* and 3*b*. The target steering angle setting section 73 sets target steering angles by referring to this information. Hereinafter a target steering angle set based on an operating amount of the steering member 45 is called a "base target steering angle." Normally, a target steering angle of the first outboard motor 3*a* (hereinafter called a "first target steering angle") and a target steering angle of the second outboard motor 3*b* (hereinafter called "second target steering angle") are each set to a base target steering angle.

When a steering angle difference between an actual steering angle of the first outboard motor 3*a* and an actual steering angle of a second outboard motor 3*b* is equal to or larger than a prescribed value, the target steering angle revising section 74 revises the target steering angles such that an increase of the steering angle difference is prevented. More specifically, the target steering angle revising section 74 calculates a leftward collision limit value Llimit shown in FIG. 5 and a rightward collision limit value Rlimit shown in FIG. 6. The leftward collision limit value Llimit is calculated using the mathematical expression 1 shown below. In the mathematical expression shown below, the steering angle is defined to be 0 when the watercraft is traveling straight, a positive value when the steering angle is oriented leftward of the steering angle corresponding to straight travel, and a negative value when the steering angle is oriented rightward of the steering angle corresponding to straight travel.

$$Llimit=AL+B(AL)-C \quad \text{Mathematical Expression 1}$$

Figure 5:
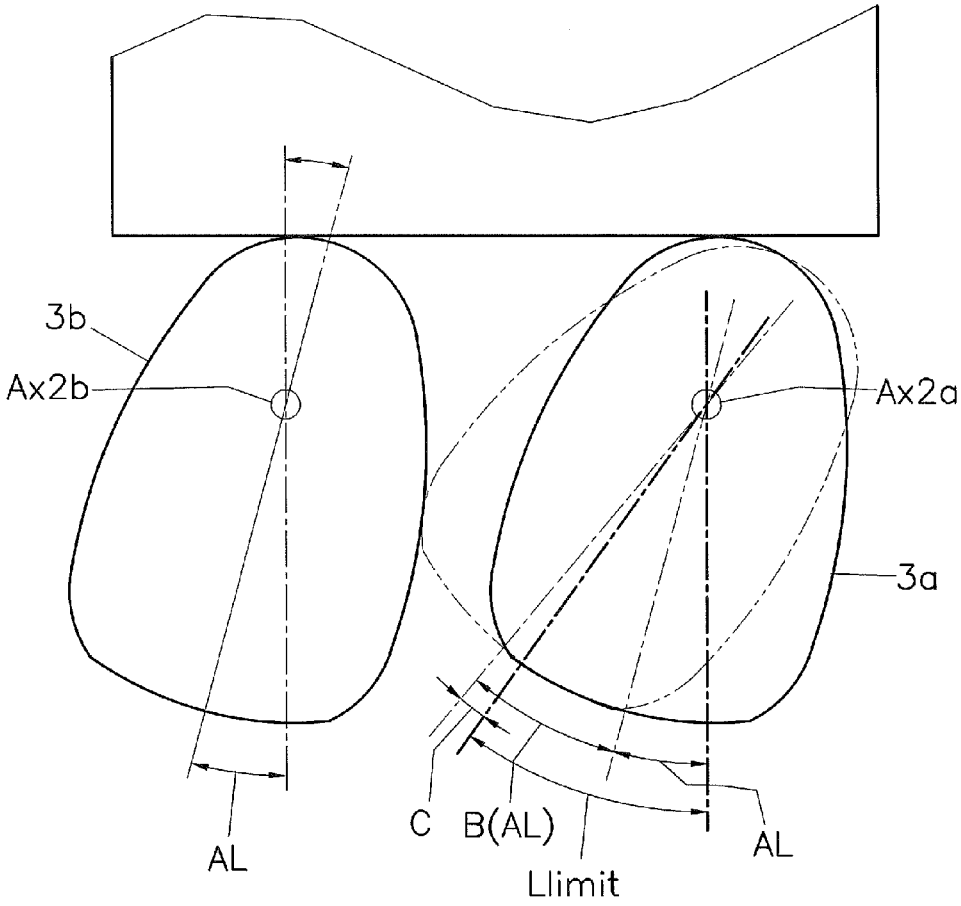
FIG. 5 is a simple diagram of an outboard motor steering operation occurring when a steering member is operated leftward.
Figure 8C:
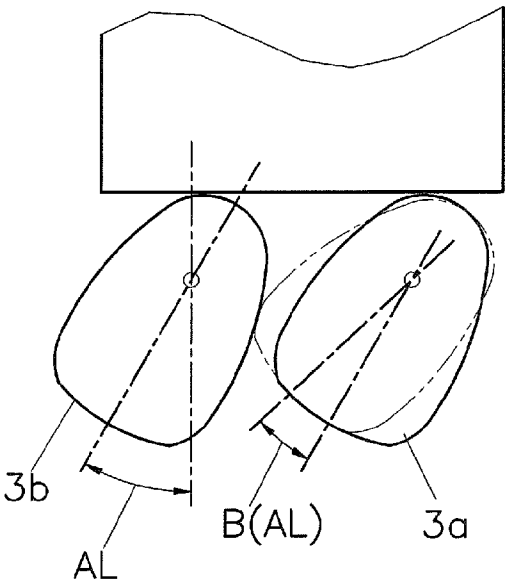
FIGS. 8A to 8C are simple diagrams of a plurality of outboard motors illustrating how a clearance differs depending on an actual steering angle.
Figure 8B:
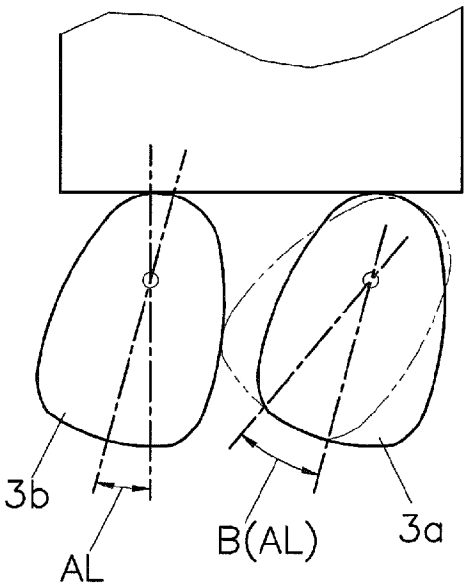
Figure 8A:
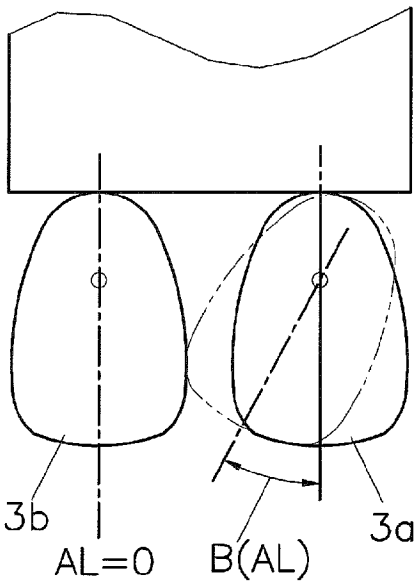
Figure 9:
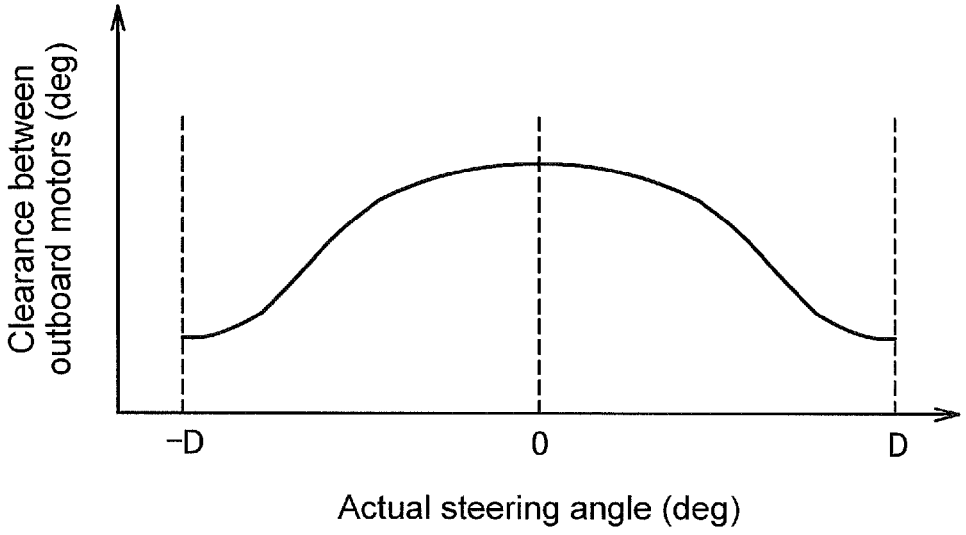
FIG. 9 is a graph showing a relationship between actual steering angle and clearance.

As shown in FIG. 5, Llimit is a leftward collision limit value for the first outboard motor 3*a*. AL is an actual steering angle of the second outboard motor 3*b*, i.e., the outboard motor positioned leftward of the first outboard motor 3*a*. That is, AL is an actual steering angle of the second outboard motor 3*b* detected by the second steering angle detecting section 34*b*. B(AL) is a clearance angle between the first outboard motor 3*a* and the second outboard motor 3*b* in a situation where the steering angles of the first outboard motor 3*a* and the second outboard motor 3*b* are the same, i.e., a situation where the first outboard motor 3*a* and the second outboard motor 3*b* are parallel to each other. As shown in FIGS. 8A to 8C, the clearance B(AL) changes according to the actual steering angle AL of the second outboard motor 3*b*. Thus, as shown in FIG. 9, the clearance is set according to the actual steering angle of the second outboard motor 3*b*. The clearance is maximum when the actual steering angle of the second outboard motor 3*b* is 0. The clearance decreases as the actual steering angle of the second outboard motor 3*b* increases from 0. The clearance also decreases as the actual steering angle of the second outboard motor 3*b* decreases from 0. C is a margin anticipating that a change of the steering angle may be subject to overshoot. The overshoot is an unintended temporary deviation from the target steering angle, for instance due to mechanical factors (stiffness of the engine or boat materials) or electrical factors. It is acceptable for C to be a constant or to be varied according to the steering angle of the first outboard motor 3*a*.

The target steering angle revising section 74 determines if a base target steering angle exceeds the leftward collision limit value Llimit in a direction of approaching the second outboard motor 3*b*. More specifically, the target steering angle revising section 74 determines if the relationships expressed in the mathematical expressions 2 and 3 shown below are satisfied.

$$At(N)-AL(N-1)>0 \quad \text{Mathematical Expression 2}$$

$$At(N)>Llimit \quad \text{Mathematical Expression 3}$$

At(N) is a current base target steering angle. AL(N−1) is a first target steering angle set in the previous determination cycle. In an initial determination cycle, the first target steering angle AL(N−1) is set to the base target steering angle. The mathematical expression 2 is used to determine if the steering member 45 is being operated leftward. FIG. 5 is a simple diagram showing a steering operation of the outboard motors 3*a* and 3*b* occurring when the steering member 45 is operated leftward. As explained previously, during normal driving the first target steering angle and the second target steering angle are set to a base target steering angle according to an operating amount of the steering member 45. Thus, as shown in FIG. 5, when the steering member 45 is operated leftward, the first outboard motor 3*a* and the second outboard motor 3*b* should be turned leftward at the same steering angle. However, if an engine angular displacement speed of the second outboard motor 3*b* is slower than an engine angular displacement speed of the first outboard motor 3*a*, then the first outboard motor 3*a* will move closer to the second outboard motor 3*b*. In such a case, if the first target steering angle, i.e., the base target steering angle, is larger than the leftward collision limit value Llimit in a direction of approaching the second outboard motor 3*b*, then the first outboard motor 3*a* has moved close to the second outboard motor 3*b* and there is a possibility that the first outboard motor 3*a* will collide with the second outboard motor 3*b*. Therefore, it can be determined if the first outboard motor 3*a* is close to the second outboard motor 3*b* by determining if the base target angle At(N) is larger than the leftward collision limit value Llimit, as indicated by the mathematical expression 3.

If it is determined that both the mathematical expression 2 and the mathematical expression 3 are satisfied, then the target steering angle revising section 74 revises the first target steering angle to the leftward collision limit value Llimit. Meanwhile, regarding the second target steering angle, the target steering angle revising section 74 maintains the base target steering angle At(N) without revising it.

Figure 10:
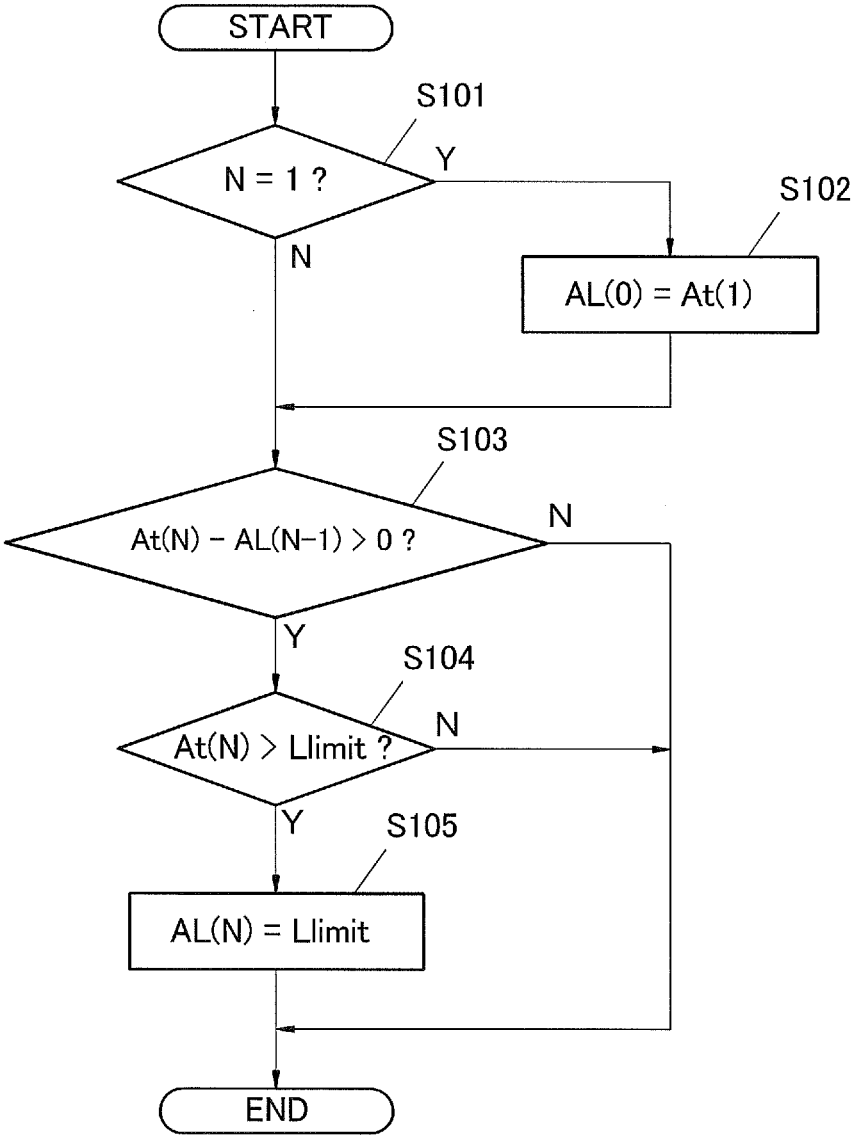
FIG. 10 is a flowchart showing a target steering angle revision process.

FIG. 10 is a flowchart showing the target steering angle revision process executed by the target steering angle revising section 74. In step S101, the target steering angle revising section 74 determines if a determination count N is 1. In other words, the target steering angle revising section 74 determines if the current determination is an initial determination. If the determination count N is 1, then the target steering angle revising section 74 executes step S102. In step S102, the target steering angle revising section 74 sets the first target steering angle AL(0) to the base target steering angle At(1). If the determination count N is not 1, then the target steering angle revising section 74 executes step S103 and step S104. In step S103, the target steering angle revising section 74 determines if the mathematical expression 2 is satisfied. Instep S104, the target steering angle revising section 74 determines if the mathematical expression 3 is satisfied. If the mathematical expressions 2 and 3 are satisfied, then the target steering angle revising section 74 executes step S105. In step S105, the target steering angle revising section 74 revises the first target steering angle AL(N) to the leftward collision limit value Llimit. If the mathematical expression 2 is not satisfied in step S103 or the mathematical expression 3 is not satisfied in step S104, then the target steering angle revising section 74 does not revise the first target steering angle AL(N). That is, the target steering angle revising section 74 maintains the first target steering angle AL(N) at the base target steering angle At(N).

Figure 6:
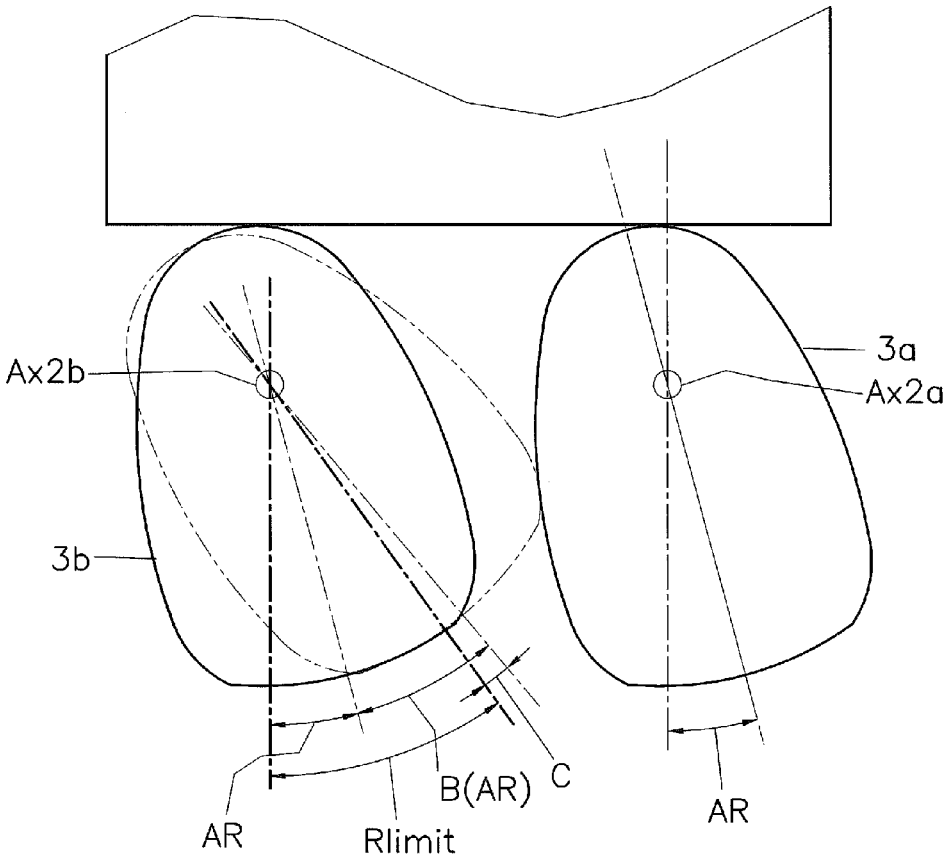
FIG. 6 is a simple diagram showing an outboard motor steering operation occurring when a steering member is operated rightward.
Figure 7:
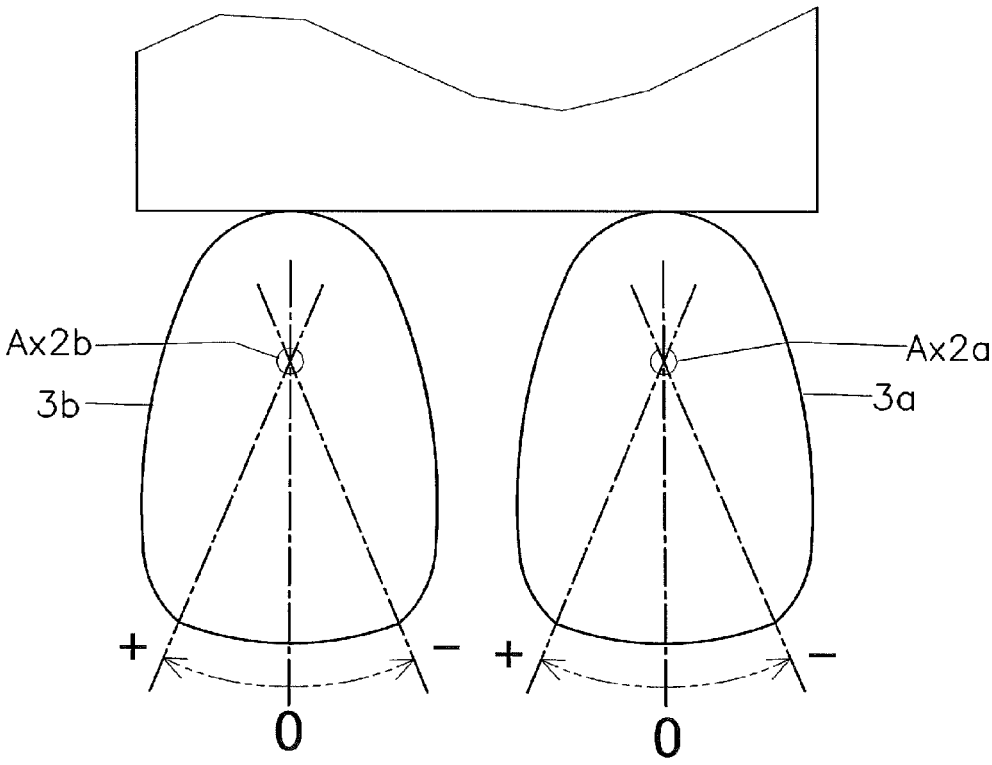
FIG. 7 is a simple diagram of a plurality of outboard motors illustrating a definition of steering angle.

The rightward collision limit value Rlimit shown in FIG. 6 is calculated using the mathematical expression 4 shown below.

$$Rlimit=AR-B(AR)+C \quad \text{Mathematical Expression 4}$$

Rlimit is a rightward collision limit value for the second outboard motor 3*b*. AR is an actual angle of the first outboard motor 3*a*, i.e., the outboard motor positioned rightward of the second outboard motor 3*b*. That is, AR is an actual steering angle of the first outboard motor 3*a* detected by the first steering angle detecting section 34*a*. B(AR) is a clearance angle between the first outboard motor 3*a* and the second outboard motor 3*b* in a situation where the steering angles of the first outboard motor 3*a* and the second outboard motor 3*b* are the same, i.e., a situation where the first outboard motor 3*a* and the second outboard motor 3*b* are parallel to each other, and is defined similarly to the clearance B(AL) explained previously. B(AR) is set according to an actual steering angle AR of the first outboard motor 3*a*. Similarly to the mathematical expression 1, C is a margin anticipating that a change of the steering angle will incur overshoot. It is acceptable for C to be a constant or to be varied according to the steering angle of the second outboard motor 3*b*.

The target steering angle revising section 74 determines if a base target steering angle exceeds the rightward collision limit value Rlimit in a direction of approaching the first outboard motor 3*a*. More specifically, it determines if the relationships expressed in the mathematical expressions 5 and 6 shown below are satisfied.

$$At(N)-AR(N-1)<0 \quad \text{Mathematical Expression 5}$$

$$At(N)<R\text{limit} \quad \text{Mathematical Expression 6]}$$

At(N) is a current base target steering angle, as explained previously. AR(N−1) is a second target steering angle set in the determination process of the previous control cycle. In an initial determination cycle, the second target steering angle AR(N−1) is set to the base target steering angle. The mathematical expression 5 serves to determine if the steering member 45 is being operated rightward. FIG. 6 is a simple diagram showing a steering operation of the outboard motors 3*a* and 3*b* occurring when the steering member 45 is operated rightward. As explained previously, during normal driving the first target steering angle and the second target steering angle are set to a base target steering angle according to an operating amount of the steering member 45. Thus, as shown in FIG. 6, when the steering member 45 is operated rightward, the first outboard motor 3*a* and the second outboard motor 3*b* should be turned rightward at the same steering angle. However, if an engine angular displacement speed of the first outboard motor 3*a*, i.e., a speed at which the outboard motor 3*a* is rotated around its steering axis Ax2*a* is slower than an engine angular displacement speed of the second outboard motor 3*b*, i.e., a speed at which the outboard motor 3*b* is rotated around its steering axis Ax2*b*, then the second outboard motor 3*b* will move closer to the first outboard motor 3*a*. In such a case, if the second target steering angle, i.e., the base target steering angle At(N), is larger than the rightward collision limit value Rlimit in a direction of approaching the first outboard motor 3*a*, then the second outboard motor 3*b* has moved close to the first outboard motor 3*a* and there is a possibility that the second outboard motor 3*b* will collide with the first outboard motor 3*a*. Therefore, it is determined if the second outboard motor 3*b* is close to the first outboard motor 3*a* by determining if the base target angle At(N) is smaller than the rightward collision limit value Rlimit, as indicated by the mathematical expression 6.

If it is determined that both the mathematical expression 5 and the mathematical expression 6 are satisfied, then the target steering angle revising section 74 revises the second target steering angle to the rightward collision limit value Rlimit. In such a case, the target steering angle revising section 74 maintains the first target steering angle at the base target steering angle without revising it.

Figure 11:
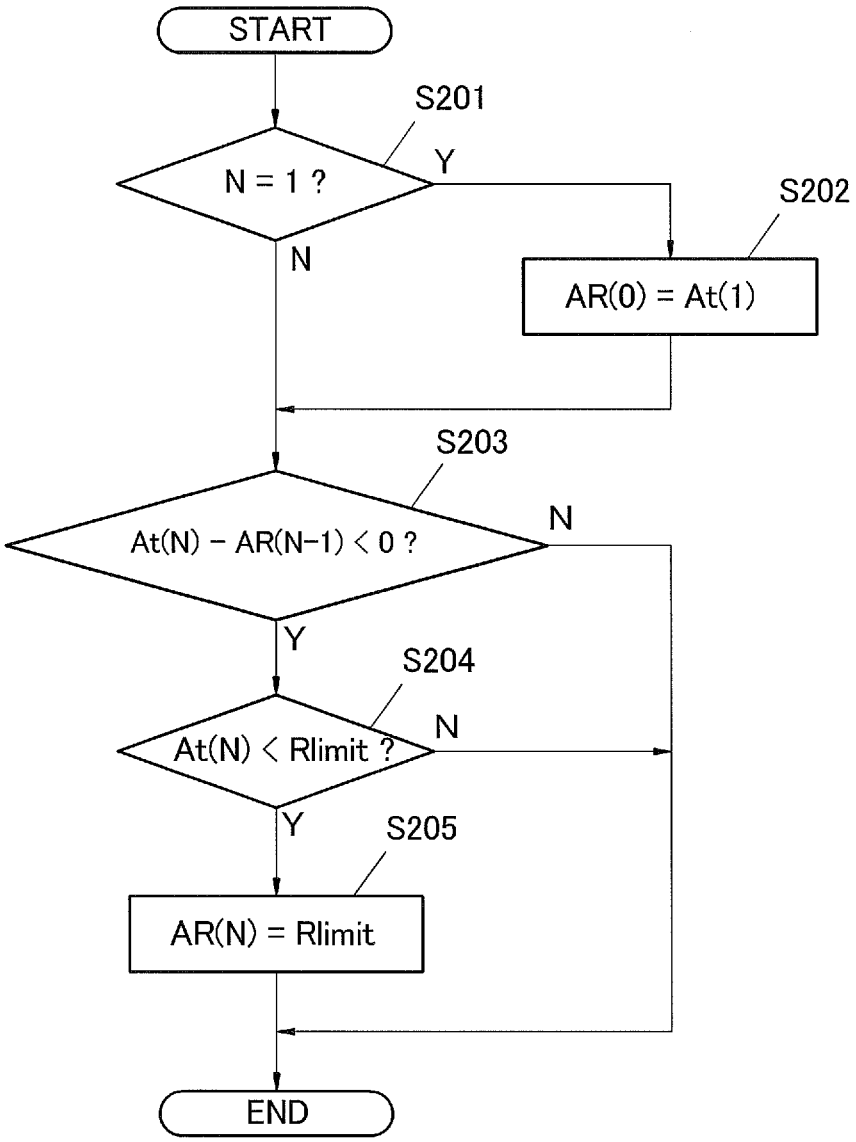
FIG. 11 is a flowchart showing a target steering angle revision process.

FIG. 11 is a flowchart showing the target steering angle revision process executed by the target steering angle revising section 74. In step S201, the target steering angle revising section 74 determines if a determination count N is 1. In other words, the target steering angle revising section 74 determines if the current determination is an initial determination. If the determination count N is 1, then the target steering angle revising section 74 executes step S202. In step S202, the target steering angle revising section 74 sets the second target steering angle AR(0) to the base target steering angle At(1). If the determination count N is not 1, then the target steering angle revising section 74 executes step S203 and step S204. In step S203, the target steering angle revising section 74 determines if the mathematical expression 5 is satisfied. In step S204, the target steering angle revising section 74 determines if the mathematical expression 6 is satisfied. If the mathematical expressions 5 and 6 are satisfied, then the target steering angle revising section 74 executes step S205. In step S205, the target steering angle revising section 74 revises the second target steering angle AR(N) to the rightward collision limit value Rlimit. If the mathematical expression 5 is not satisfied in step S203 or the mathematical expression 6 is not satisfied in step S204, then the target steering angle revising section 74 does not revise the second target steering angle AR(N). That is, the target steering angle revising section 74 maintains the second target steering angle AR(N) at the base target steering angle At(N).

When the target steering angle revising section 74 does not revise the first target steering angle or the second target steering angle, the target steering angle revising section 74 sets both the first target steering angle and the second target steering angle to the base target steering angle. The determinations shown in FIG. 10 and FIG. 11 are executed repeatedly according to a short cycle period (e.g., several milliseconds).

The command section 76 shown in FIG. 4 issues command signals to the first steering actuator 33*a* in accordance with the first target steering angle. The command section 76 issues command signals to the second steering actuator 33*b* in accordance with the second target steering angle. Thus, when the actual steering angle of the first outboard motor 3*a* enters a region exceeding the leftward collision limit value Llimit as shown in FIG. 5, the first target steering angle is revised to the leftward collision limit value Llimit. The leftward collision limit value Llimit is set according to the actual steering angle of the second outboard motor 3*b*. Consequently, the first target steering angle is set according to the actual steering angle of the second outboard motor 3*b*. Thus, the engine angular displacement speed of the first outboard motor 3*a* is decreased in accordance with the engine angular displacement speed of the second outboard motor 3*b*. As a result, the first outboard motor 3*a* is prevented from colliding against the second outboard motor 3*b*. When, conversely, the actual steering angle of the second outboard motor 3*b* enters a region exceeding the rightward collision limit value Rlimit as shown in FIG. 6, the second target steering angle is revised to the rightward collision limit value Rlimit. The rightward collision limit value Rlimit is set according to the actual steering angle of the first outboard motor 3*a*. Consequently, the second target steering angle is set according to the actual steering angle of the first outboard motor 3*a*. Thus, the engine angular displacement speed of the second outboard motor 3*b* is decreased in accordance with the engine angular displacement speed of the first outboard motor 3*a*. As a result, the second outboard motor 3*b* is prevented from colliding against the first outboard motor 3*a*.

The tracking failure detecting section 75 shown in FIG. 4 monitors a difference between the first target steering angle and the first actual steering angle and issues a failure detection signal when it detects an abnormal difference. The tracking failure detecting section 75 also monitors a difference between the second target steering angle and the second actual steering angle and issues a failure detection signal when it detects an abnormal difference. More specifically, the tracking failure detecting section 75 detects if a difference between the first target steering angle and the first actual steering angle (hereinafter called "first steering angle difference") is larger than a prescribed angle difference threshold value. If so, then the tracking failure detecting section 75 measures a continuation time over which a state of the first steering angle difference being larger than the prescribed angle difference threshold value has continued. If the continuation time becomes equal to or larger than a prescribed time threshold value, then the tracking failure detecting section 75 issues a failure detection signal. Meanwhile, the tracking failure detecting section 75 detects if a difference between the second target steering angle and the second actual steering angle (hereinafter called "second steering angle difference") is larger than a prescribed angle difference threshold value. If so, then the tracking failure detecting section 75 measures a continuation time over which a state of the second steering angle difference being larger than the prescribed angle difference threshold value has continued. If the continuation time becomes equal to or larger than a prescribed time threshold value, then the tracking failure detecting section 75 issues a failure detection signal.

When the tracking failure detecting section 75 issues the failure detection signal, the command section 76 stops the steering operations of the first outboard motor 3*a* and the second outboard motor 3*b*. Or, the command section 76 decreases the engine rotational speeds of the first outboard motor 3*a* and the second outboard motor 3*b* such that the vessel speed decreases. Additionally, it is acceptable for the command section 76 to display a warning on a display device arranged at the helm seat 4.

As explained previously, a watercraft control system according to the present preferred embodiment executes a target steering angle revision process and a tracking failure detecting process. In the target steering angle revision process, the watercraft control system monitors if a target steering angle of the first outboard motor 3*a* and a target steering angle of the second outboard motor 3*b* have exceeded a leftward collision limit value and a rightward collision limit value. If a target steering angle of the first outboard motor 3*a* and the second outboard motor 3*b* exceeds either of the leftward and rightward collision limit values, then the target steering angle is revised by decreasing the engine angular displacement speed of the outboard motor that is turning faster. In this manner, when the steering angle difference between the first outboard motor 3*a* and the second outboard motor 3*b* becomes equal to or larger than a prescribed value, the steering operation of the outboard motors is controlled such that an increase of the steering angle difference is avoided. As a result, a collision between the first outboard motor 3*a* and the second outboard motor 3*b* is avoided.

In the tracking failure detection process, the outboard motor control system monitors if a state in which a difference between a target steering angle and an actual steering angle is larger than a prescribed angle difference threshold value has continued for a prescribed amount of time or longer. If a difference between a target steering angle and an actual steering angle has been larger than the prescribed angle difference threshold value for a prescribed amount of time or longer, then the outboard motor steering operation is stopped or the engine rotational speed is decreased by issuing a failure detection signal. In other words, a process for detecting a tracking failure is executed separately from a process for preventing a collision. Thus, unnecessary reductions of the vessel speed are prevented in comparison with a configuration in which a tracking failure is assumed and the engine rotational speed is immediately decreased when it is detected that there is a possibility of a collision between the first outboard motor 3*a* and the second outboard motor 3*b*. Likewise, adverse effects on the handling of the watercraft are significantly reduced or prevented in comparison with a configuration in which a tracking failure is assumed and the outboard motor steering operation is immediately stopped when it is detected that there is a possibility of a collision between the first outboard motor 3*a* and the second outboard motor 3*b*.

Although preferred embodiments of the present invention have been explained above, the present invention is not limited to these preferred embodiments. Various changes can be made without departing from the scope of the present invention.

Although in the previously explained preferred embodiments the steering device 5 is preferably exemplified as a steering wheel, it is also acceptable to use a joystick.

Although in the previously explained preferred embodiments the base target steering angle is preferably the same for both the first outboard motor 3*a* and the second outboard motor 3*b*, it is acceptable to set separate base target steering angles for each outboard motor. In other words, it is acceptable for the target steering angle setting section 73 to set a first base target steering angle as a target steering angle for the first outboard motor 3*a* and a second base target steering angle as a target steering angle for the second outboard motor 3*b*. In such a case, it is acceptable for the values of the first base target steering angle and the second base target steering angle to be different.

Although in the previously explained preferred embodiments the controller 7 is preferably provided independently from other devices, it is acceptable to install the controller 7 in another device. For example, it is acceptable to install the controller 7 in the steering device 5.

It is also acceptable for an outboard motor control system according to a preferred embodiment of the present invention to control three or more outboard motors. In such a case, the same control as explained heretofore is preferably used by treating two left-right adjacent outboard motors as though the rightward outboard motor is the first outboard motor 3*a* and the leftward outboard motor is the second outboard motor 3*b*.

Figure 12:
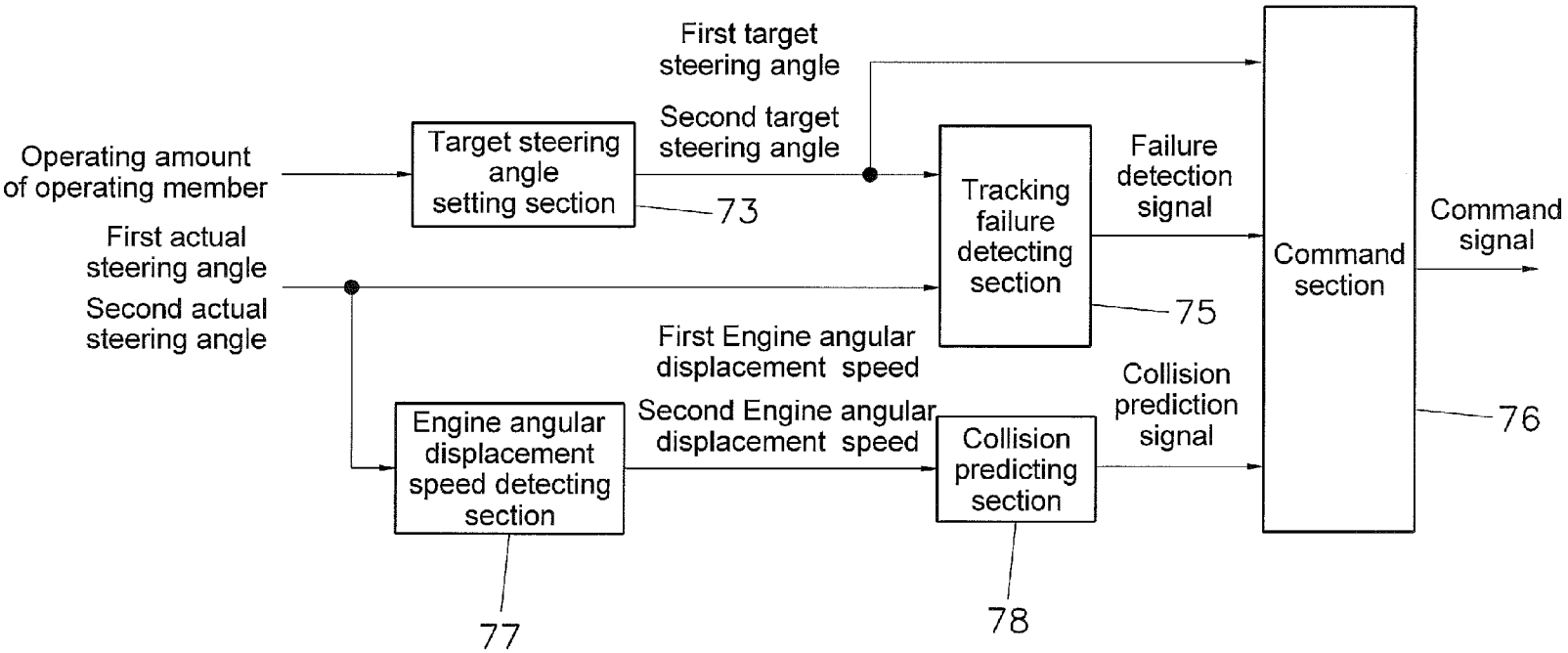
FIG. 12 is a block diagram showing constituent features of a control section of an outboard motor control system according to another preferred embodiment of the present invention.

Although in the previously explained preferred embodiments the leftward collision limit value Llimit and the rightward collision limit Rlimit are preferably used to predict a collision of the outboard motors 3*a* and 3*b*, it is acceptable to use another determination method for predicting a collision of the outboard motors 3*a* and 3*b*. For example, it is acceptable to predict a collision of the outboard motors 3*a* and 3*b* based on an engine angular displacement speed. In such a case, the outboard motor control system is equipped with an engine angular displacement speed detecting section 77 and a collision predicting section 78 as shown in FIG. 12. The engine angular displacement speed detecting section 77 calculates an engine angular displacement speed of the first outboard motor 3*a* (hereinafter called "first engine angular displacement speed") based on, for example, a first actual steering angle. The engine angular displacement speed detecting section 77 also calculates an engine angular displacement speed of the second outboard motor 3*b* (hereinafter called "second engine angular displacement speed") based on, for example, a second actual steering angle. The collision predicting section 78 predicts a collision of the outboard motors 3*a* and 3*b* based on the first engine angular displacement speed and the second engine angular displacement speed. For example, the collision predicting section 78 predicts that a collision of the outboard motors 3*a* and 3*b* will occur when a difference between the first engine angular displacement speed and the second engine angular displacement speed is larger than a prescribed speed threshold value. When the collision predicting section 78 has predicted a collision of the outboard motors 3*a* and 3*b*, the command section 76 issues a command signal instructing to decrease the engine angular displacement speed of the outboard motor that is turning with a faster engine angular displacement speed. For example, if the first outboard motor 3*a* is turning with a faster engine angular displacement speed than the second outboard motor 3*b*, then the command section 76 will issue a command signal to the first steering actuator 33*a* to decrease the engine angular displacement speed of the first outboard motor 3*a*. Conversely, if the second outboard motor 3*b* is turning with a faster engine angular displacement speed than the first outboard motor 3*a*, then the command section 76 will issue a command signal to the second steering actuator 33*b* to decrease the engine angular displacement speed of the second outboard motor 3*b*. With such a configuration, a collision of the outboard motors 3*a* and 3*b* is avoided.

In the previously explained preferred embodiments, the target steering angle revising section 74 preferably revises the first target steering angle to the leftward collision limit value Llimit and revises the second target steering angle to the rightward collision limit value Rlimit. However, it is also acceptable to revise to another value. For example, it is acceptable to revise the first target steering angle to a value smaller than the leftward collision limit value Llimit and it is acceptable to revise the second target steering angle to a value larger than the rightward collision limit value Rlimit. That is, when there is a possibility of a collision, the first target steering angle and the second target steering angle are set to values that enable the collision to be avoided instead of setting the target steering angles strictly to the collision limit values.

In the previously explained preferred embodiments, a leftward operation of the steering member 45 is preferably determined by comparing a current base target steering angle to a first target steering angle set in the determination process of the previous control cycle. Similarly, a rightward operation is preferably determined by comparing a current base target steering angle to a second target steering angle set in the determination process of the previous control cycle. However, the present invention is not limited to the method of determining an operation direction of the steering member 45 presented in the previously explained preferred embodiments. For example, it is acceptable to detect the operation direction of the steering member 45 based on an actual steering angle of the first outboard motor 3*a* and an actual steering angle of the second outboard motor 3*b*. However, it is possible for an actual steering angle to differ from a target steering angle in some situations due to a response delay of the steering actuators 33*a* and 33*b*. Thus, in order to detect the steering direction intended by an operator, it is preferable to use a detection method based on a target steering angle as is done in the previously explained preferred embodiments.

Figure 13:
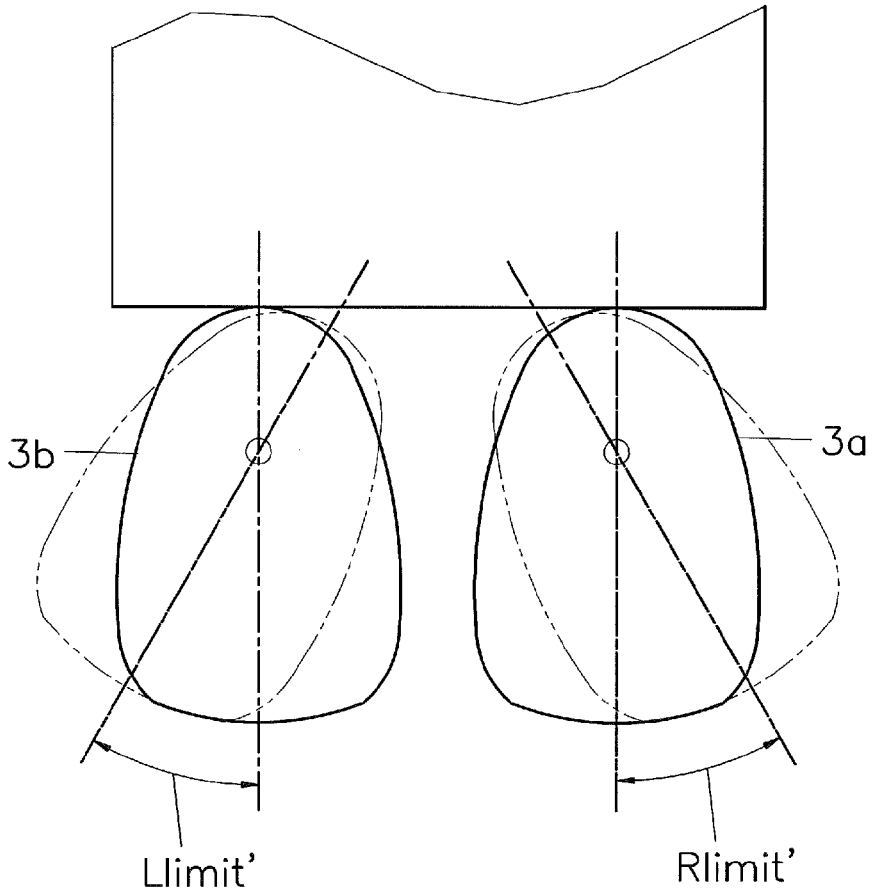
FIG. 13 is a simple diagram showing a steering operation of an outboard motor by an outboard motor control system according to another preferred embodiment of the present invention.

In the previously explained preferred embodiments, a target steering angle revision process is preferably executed in order to avoid a collision between the first outboard motor 3*a* and the second outboard motor 3*b*. In other words, a target steering angle revision process is executed in order to avoid an increase of the steering angle difference in a direction of the first outboard motor 3*a* and the second outboard motor 3*b* moving close together. However, it is also acceptable to execute a target steering angle revision process in order to prevent the first outboard motor 3*a* and the second outboard motor 3*b* from moving too far apart. For example, as shown in FIG. 13, it is acceptable to set a rightward separation limit value Rlimit' with respect to the first outboard motor 3*a*. In such a case, the steering operation of the first outboard motor 3*a* is controlled such that the actual steering angle of the first outboard motor 3*a* does not exceed the rightward separation limit value Rlimit' in a direction of separating from the second outboard motor 3*b*. It is acceptable to set the rightward separation limit value Rlimit' according to the actual steering angle of the second outboard motor 3*b*. It is also acceptable to set a leftward separation limit value Llimit with respect to the second outboard motor 3*b*. In such a case, the steering operation of the second outboard motor 3*b* is controlled such that the actual steering angle of the second outboard motor 3*b* does not exceed the leftward separation limit value Llimit' in a direction of separating from the first outboard motor 3*a*. It is acceptable to set the leftward separation limit value Llimit' according to the actual steering angle of the first outboard motor 3*a*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An outboard motor control system comprising:

a plurality of outboard motors mounted on a stern of a watercraft and configured to be steered independently;

a target steering angle setting section configured to set a target steering angle for each of the plurality of outboard motors;

a plurality of actuators configured to steer each of the plurality of outboard motors such that a steering angle of each of the plurality of outboard motor becomes equal or substantially equal to the target steering angle;

an actual steering angle detecting section configured to detect an actual steering angle of each of the plurality of outboard motors; and a control section programmed and configured to control a steering operation of the plurality of outboard motors such that, when a steering angle difference defining a difference between the actual steering angles of adjacently arranged outboard motors becomes equal to or larger than a prescribed value, an increase of the steering angle difference is prevented.

2. The outboard motor control system according to claim 1, wherein, when a state in which a difference between the target steering angle set by the target steering angle setting section and the actual steering angle detected by the actual steering angle detecting section is equal to or larger than a prescribed value has continued for a prescribed amount of time or longer, the control section is programmed and configured to control the plurality of outboard motors such that the steering operation of the plurality of outboard motors is stopped or such that a vessel speed is decreased.

3. The outboard motor control system according to claim 1, wherein, when the steering angle difference is equal to or larger than the prescribed value, the control section is programmed and configured to decrease an engine angular displacement speed of the outboard motor having a faster engine angular displacement speed.

4. The outboard motor control system according to claim 3, wherein, when the steering angle difference is equal to or larger than the prescribed value, the control section is programmed and configured to set the target steering angle of the outboard motor having a faster engine angular displacement speed based on the actual steering angle of the outboard motor having a slower engine angular displacement speed.

5. The outboard motor control system according to claim 1, wherein the prescribed value is set according to the actual steering angle of one of the plurality of outboard motors.

6. The outboard motor control system according to claim 1, wherein the plurality of outboard motors include a reference outboard motor and a comparative outboard motor arranged adjacent to the reference outboard motor; and when the plurality of outboard motors are being steered such that the comparative outboard motor approaches the reference outboard motor and the actual steering angle of the comparative outboard motor has entered a prescribed determination angle region based on the actual steering angle of the reference outboard motor, the control section is programmed and configured to set the target steering angle of the comparative outboard motor to the steering angle based on the actual steering angle of the reference outboard motor.

7. The outboard motor control system according to claim 1, further comprising:

an engine angular displacement speed detection section configured to detect an engine angular displacement speed of each of the plurality of outboard motors; wherein the control section is programmed and configured to predict a collision of the plurality of outboard motors based on the engine angular displacement speeds and when the control section predicts that a collision will occur if the steering operation at the detected engine angular displacement speeds is continued, the control section is programmed and configured to control one of the plurality of actuators so as to decrease the engine angular displacement speed of the outboard motor having a faster engine angular displacement speed.

8. An outboard motor control method for a plurality of outboard motors mounted on a stern of a watercraft and being configured to be steered independently, the method comprising the steps of:

setting a target steering angle for each of the plurality of outboard motors;

steering the plurality of outboard motors such that a steering angle of each of the plurality of outboard motors becomes equal or substantially equal to the target steering angle;

detecting an actual steering angle of each of the plurality of outboard motors; and controlling a steering operation of the plurality of outboard motors such that, when a steering angle difference defining a difference between the actual steering angles of adjacently arranged outboard motors becomes equal to or larger than a prescribed value, an increase of the steering angle difference is prevented.

* * * * *